US005524565A

United States Patent [19]

Lavin

[11] Patent Number: 5,524,565

[45] Date of Patent: Jun. 11, 1996

[54] PROTECTIVE CUSHION FOR A SAILBOAT BOOM

[76] Inventor: Kenneth M. Lavin, 272 Chauncy St., Mansfield, Mass. 02048

[21] Appl. No.: 431,835

[22] Filed: May 1, 1995

[51] Int. Cl.[6] ..... B63B 15/00

[52] U.S. Cl. ..... 114/97; 114/89; 114/219; 114/39.1

[58] Field of Search ..... 280/756; 248/345.1; 114/39.1, 39.2, 219, 343, 364, 89, 97, 90, 102, 270; 267/140; 482/106, 107; 273/55 D

[56] References Cited

U.S. PATENT DOCUMENTS

| | | | |
|---|---|---|---|
| 3,782,724 | 1/1974 | Rottman et al. | 273/55 D |
| 3,884,495 | 5/1975 | Petock | 248/345.1 |
| 3,958,801 | 5/1976 | Correa | 272/63 |
| 4,280,431 | 7/1981 | Sofen | 114/105 |
| 4,503,797 | 3/1985 | Maurin | 114/106 |
| 5,205,235 | 4/1993 | Hodges | 114/290 |

FOREIGN PATENT DOCUMENTS

| | | | |
|---|---|---|---|
| 3741803 | 6/1989 | Germany . | |
| 1285334 | 11/1989 | Japan | 280/756 |

*Primary Examiner*- Edwin L. Swinehart
*Attorney, Agent, or Firm*- Dowell & Dowell

[57] ABSTRACT

A cushion for the boom of a sailboat including at least one preformed sleeve or flexible wrap of a soft resilient material which is configured to overly at least the entire opposite side portions of the boom along substantially the entire length thereof, and fasteners for selectively removably mounting the cushion on the boom.

20 Claims, 4 Drawing Sheets

Fig.5
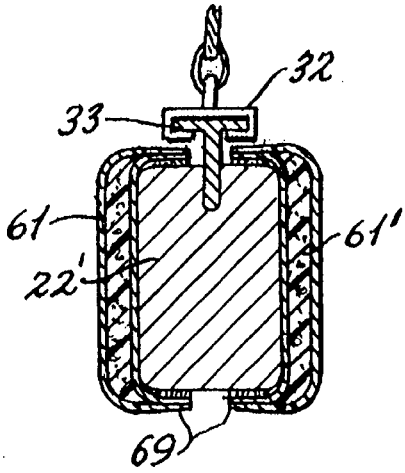
Fig.4
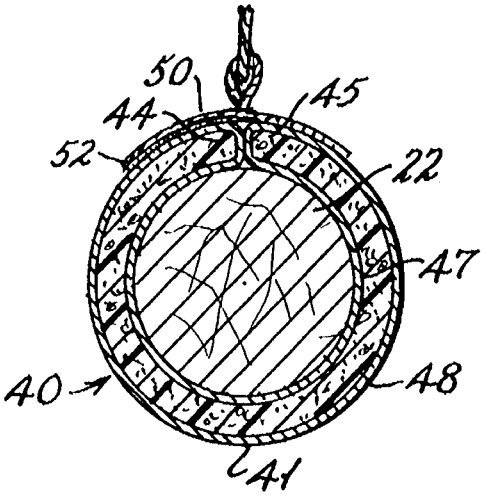
Fig.6
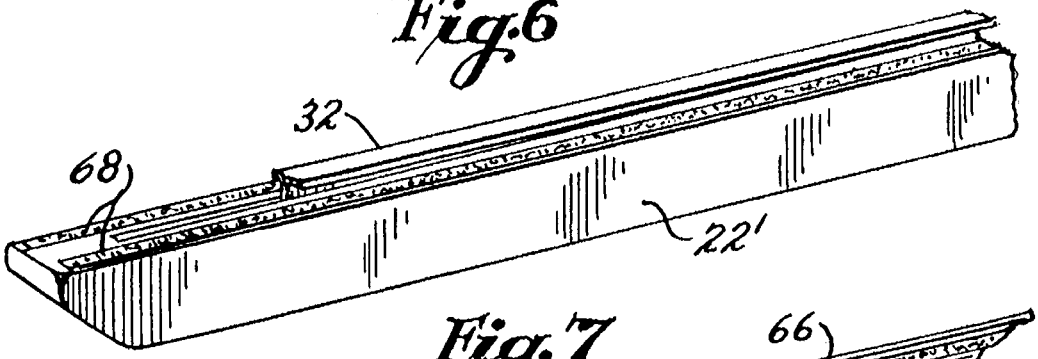
Fig.7
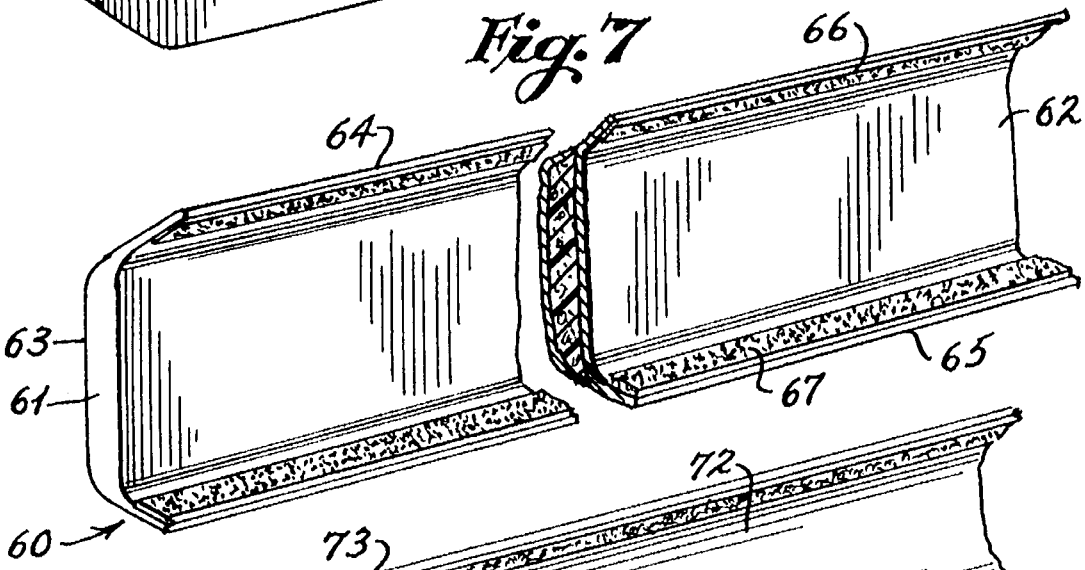
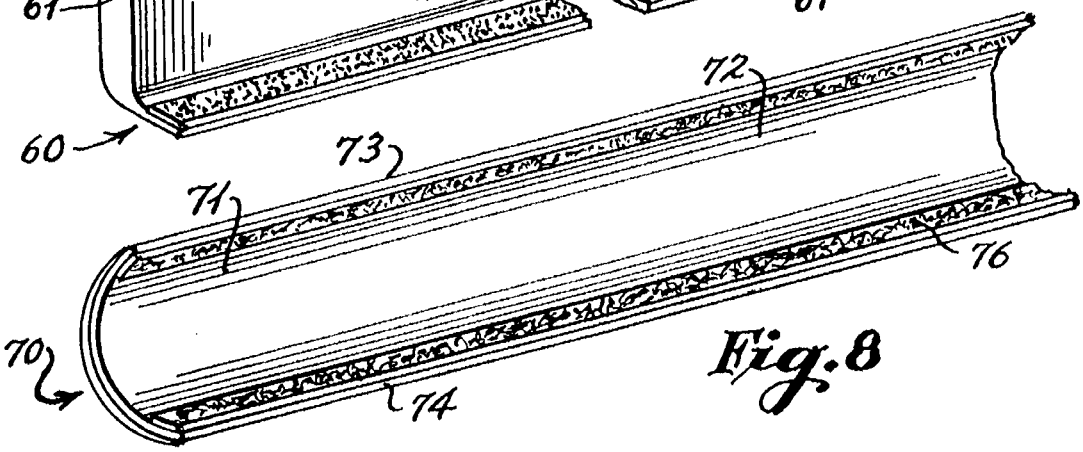
Fig.8

PROTECTIVE CUSHION FOR A SAILBOAT BOOM

BACKGROUND OF THE INVENTION

1. Field of the Invention

This invention is generally directed to safety devices which may be utilized on boats and particularly boats of the sailboat type which include a boom to which the foot of a mainsail is secured. More specifically, the present invention is directed to a protective cushion including a body portion having one or more sections which are constructed of a relatively soft and resilient material which body section or sections may be removably mounted to substantially cover or enclose the boom. In some embodiments, fastening elements are utilized to secure the body portion or sections directly to the boom whereas in other embodiments, fastening elements are utilized to secure the body portion to itself in a generally encircled relationship with respect to the boom.

2. History of the Related Art

The mainsail of a sailboat is secured along its luff or front edge to the sailboat mast and is also secured along its lower edge or foot at two or more points to a boom which extends horizontally outwardly from the mast. Generally, the boom extends from its mast end rearwardly toward the stern where the outer end of the boom is connected by a mainsheet which controls the pivotable movement of the boom relative to the mast. Depending upon wind conditions and the directional or tacking movement of the sailboat, the mainsheet, which includes a line which is connected by a pulley to the outer end of the boom, is played in or out to either swing the boom toward the centerline of the boat or to allow the boom to swing outwardly relative to the sides of the boat.

The height of the boom relative to the deck may vary and in some sailboats is adjustable. Often, however, the boom is positioned sufficient close to the deck that it becomes necessary for individuals on the deck to crouch or duck under the boom as it swings from port to starboard and from starboard to port. In many instances, the movement of the boom is unexpected and so violent that individuals are struck by the boom and seriously injured.

In U.S. Pat. No. 5,205,235 to Hodges, an external rail system for boats is disclosed which incorporates strips of polyethylene closed cell foam which are adhesively secured to various portions of the boat hull, bow, stern, and boom. The patent teaches applying rails formed of the foam covered with a skin of woven fabric at the 3:00, 4:30, 7:30, and 9:00 positions of a booms surface. The polyethylene rails along the boom are molded of a low density polyethylene foam and are provided to reduce the possibility of injury to a person in the event the boom unexpectedly contacts the head of an individual as the boom swings relative to the deck of the sailboat.

Unfortunately, the rails applied to the boom disclosed in the aforementioned United States Patent do not provide sufficient resilience or padding along the entire side surfaces of the boom. In addition, the polyethylene material exhibits sufficient rigidity that, in the event the boom violently contacted an individual, injury could still occur. Also, the sails must be permanently attached to the boom and many individuals would not place permanent strips on their boom as the strips or rails affect the aesthetic appearance of the sailboat.

In view of the foregoing, there remains a serious risk which is assumed by individuals when sailing which risk is heightened for individuals who are not familiar with the characteristics of the boom movement of a sailboat.

SUMMARY OF THE INVENTION

The present invention is directed to a cushion for the boom of a sailboat and in the preferred embodiment includes at least one preformed sleeve or flexible wrap of relatively soft resilient material wherein the body portion of the cushion is defined having opposite ends and opposing sides. The body of the cushion is removably mounted and secured using various fasteners in such a manner that the cushion substantially encircles the boom along a substantial portion of its length.

The cushion is preferably coated or covered on at least the exterior surface with a water-resistant layer. A padded type cushion may also be formed of a fibrous type material which is resilient so as to assume an original configuration after yielding upon impact with an individual or other object.

In some embodiments, strips of a hook and loop fabric fastening material are used which may be applied along the upper, side or lower portions of the boom with the body portion of the cushion including mating hook and loop fastening strips. The cushion may be formed in two sections which are secured with the fastening materials along the opposite sides of the boom using fastening materials on each section.

In some embodiments, the cushion may include one or more openings to allow for the passage of rigging which is connected along the length of the boom.

It is a primary object of the present invention to provide a protective cushion which may be removable secured in one or more sections along the length of a boom of a sailboat in order to reduce the possibility of physical injury to individuals brought about by the violent movement or swinging action of the boom.

It is yet a further object of the present invention to provide a protective cushion for use with sailboat booms which includes a soft resilient body which yields so as to absorb the energy of an impact to prevent physical injury to individuals and which is formed of a material which assumes it original shape following impact.

It is also an object of the present invention to provide a protective cushion for use in covering the boom of a sailboat which may be easily mounted thereto without requiring any modifications to the boom and which includes fastening elements for securing the cushion in substantially encircling relationship with respect to the boom along a substantial portion thereof.

It is yet another object of the present invention to provide a protective cushion for sailboat booms which includes preformed resilient members which may be secured to the boom by applying an adhesive or hook and loop fabric type fastening material along portions of the boom length which material cooperates with similar fastening materials mounted to the cushion, whereby the preformed members may be easily mounted without interfering with the rigging normally associated with the boom.

It is also an object of the present invention to provide a protective resilient cushion for sailboat booms which, in one embodiment, can be rolled upon itself for compact storage.

BRIEF DESCRIPTION OF THE DRAWINGS

In the accompanying drawings:

FIG. 4 is a cross-sectional view taken along lines 4—4 of FIG. 2;

FIG. 5 is a cross-sectional view through a boom having a generally rectangular cross-sectional configuration showing a second embodiment of the invention;

FIG. 6 is a perspective view of the boom of FIG. 5 having hook and loop fastening materials mounted thereto;

FIG. 7 is a perspective view having portions broken away showing the inner face of one section of cushion as shown in FIG. 5;

FIG. 8 is a perspective view showing the inner face of another embodiment of the present invention wherein the cushion sections are formed in generally semi-circular cross-sectional configuration;

DETAILED DESCRIPTION OF THE PREFERRED EMBODIMENT

Figure 1:
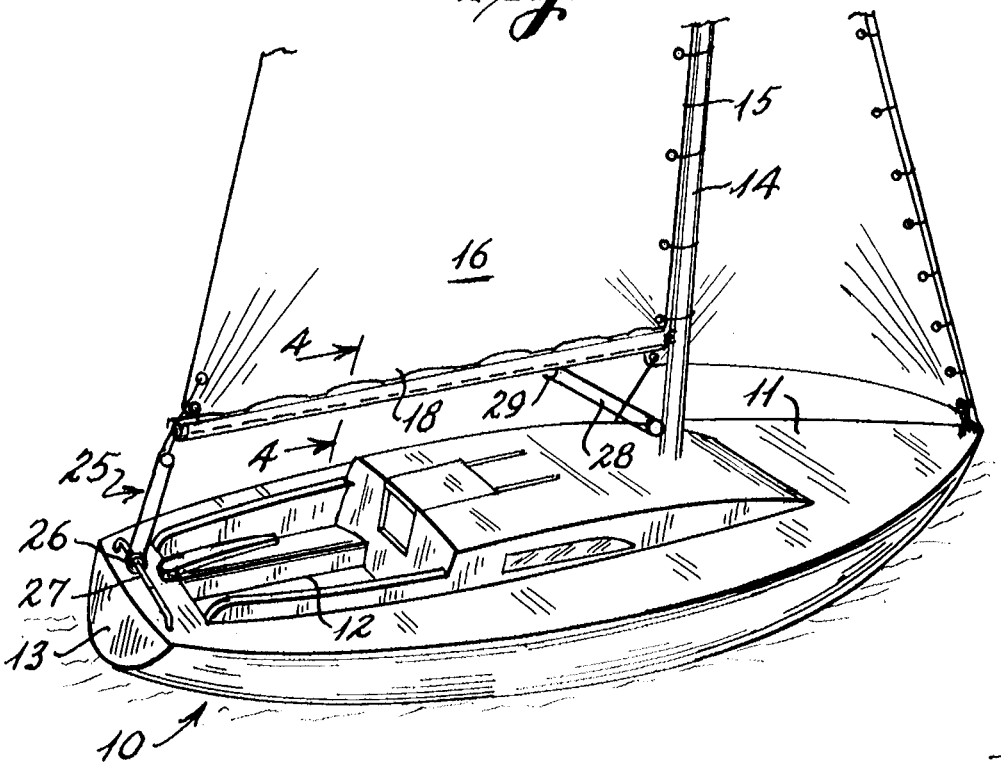
FIG. 1 is a perspective illustrational view of a sailboat having a cushion applied along the length of the boom in accordance with the teachings of the present invention.

With continued reference to the drawing figures, a sailboat 10 is shown which includes a foredeck 11, an aftdeck 12 and a stern 13. A mast 14 extends upwardly from the sailboat to which is secured the luff or front edge 15 of a mainsail 16. The foot or lower edge 18 of the sail is secured by a plurality of tie lines 19 which extend through grommets 20 which are spaced along the foot of the sail to boom 22 intermediate the tack 23 and the clew 24.

The boom is pivotable with respect to the mast so as to allow the sail angle to change relative thereto depending upon wind direction and the direction of tacking of the sailboat. The pivotable movement of the boom is controlled by a mainsheet 25 which is connected to a traveller 26 slideable along a guide 27 secured adjacent the stern of the boat. The forward portion of the boom is stabilized and guided by a boom vang 28 which is secured at the base of the mast and to a vang hook 29 extending from the bottom of the boom. By playing the line of the mainsheet 25 in and out, the outer end of the boom is caused to pivot from side to side relative to the sailboat.

It should be noted that the boom structure on sailboats varies and, in some instances, the foot of the mainsail is only secured to the boom at the tack 23 and clew 24. In other instances, as opposed to having tie lines for securing the foot of the mainsail to the boom, the sail may be mounted on brackets 32 which slide along a rail 33 which is mounted to and extends outwardly from the upper portion of the boom, as shown in FIG. 5.

Figure 2:
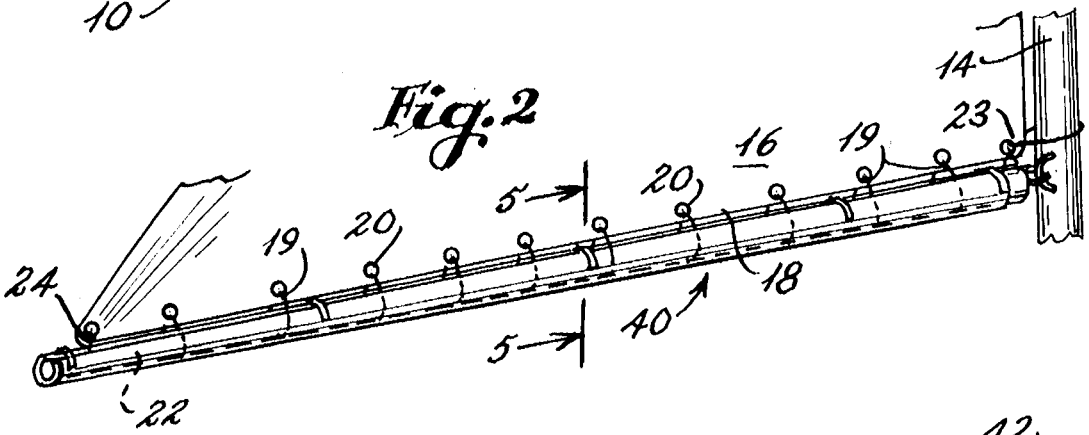
FIG. 2 is a perspective enlarged view of the boom shown in FIG. 1 showing, in greater detail, a first embodiment of the present invention mounted to the boom.
Figure 3:
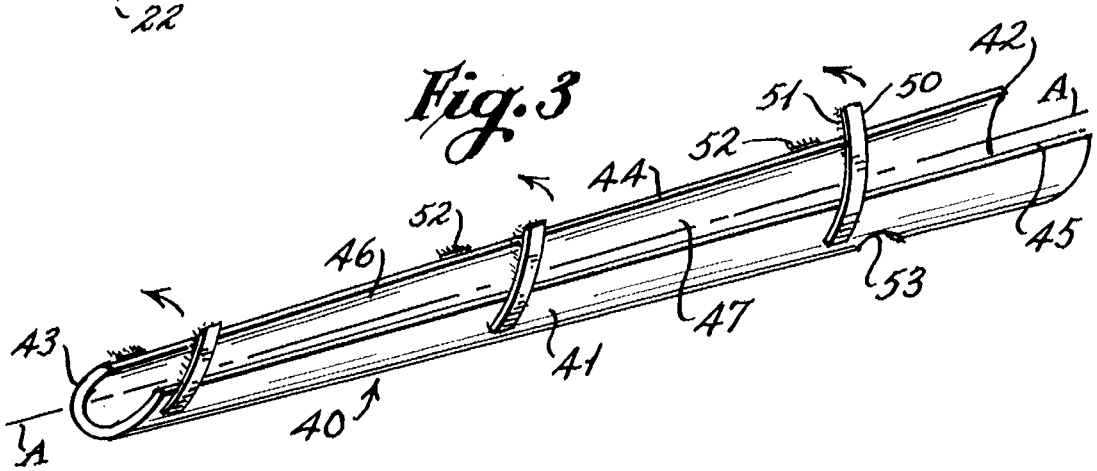
FIG. 3 is a perspective view of the embodiment shown in FIG. 2.

The present invention is provided to prevent injury to individuals on the sailboat caused by being hit by the boom as it swings relative to the sailboat. With particular reference to FIGS. 2 through 4, a first embodiment of the present invention is disclosed. In this embodiment, the boom is provided with a protective cushion 40 which consists of an elongated body portion 41 in the form of an open tubular sleeve having a first end 42 which is designed to be positioned adjacent the mast and an outer end 43 which is designed to extend to a point adjacent the outer portion of the boom near the clew 24. The body portion further includes opposing elongated sides 44 and 45 which are normally spaced from one another by an elongated slot or opening 46. The cushion 40 is preferably formed of soft resilient material such as a spongy foam rubber. The material may be substantially any material which is capable of resiliently yielding to absorb a great deal of the impact energy when the boom contacts an object including various natural and artificial soft rubbers, soft foams and various fibrous padding and the like which are capable of yielding and then re-assuming their original configuration after impact. In the preferred embodiment, the material should be a minimum of approximately ¾ to 1 inch in thickness. The body is preferably coated on both the inner and outer surfaces with a flexible or pliable water impermeable layer 47 and 48.

As shown in FIG. 3, the body may be pre-formed in a substantially arcuate configuration wherein the inner surface 47 of the body is concave. Further, to allow the cushion to compatibly engage the length of the tapering boom, the body may be formed with a converging radius from the mast or inner end 42 to the outer end 43 thereof relative to an elongated axis A—A defined thereby. In some instances, where the boom structure is not tapered, the cross section defined by the body of the cushion will remain constant throughout its length.

As opposed to preshaping the cushion with an arcuate configuration, the cushion may be formed of in a sheet-like configuration having relatively flat front and rear surfaces but which is flexible so as to be wrapped to conform to the outer surface of the boom when attached thereto, as shown in FIGS. 10–13.

In the embodiment of FIGS. 2 through 4, a plurality of fastening elements in the form of straps 50 are secured adjacent to the side edge 45 by an appropriate adhesive, stitching or hook and loop fasteners. The inner surface of each strap 50 includes a strip of hook and loop fastening materials 51 which are selectively engageable with mating strips of hook and loop fastening materials 52 which are adhesively secured, stitch or applied by hook and loop fasteners, to the body 41 adjacent the elongated side 44 thereof, as shown in FIG. 5. The straps 50 are pulled tightly so as to urge the opposing sides 44 and 45 into close or contacting relationship to one another, as shown in FIG. 5. In some instances, due to the structure of the boom, it may be necessary to have a slight spacing or slot, such as 46, remaining between the elongated sides 44 and 45 to make space for the tie elements which connect the foot of the sail to the boom.

In order to allow for the connection of the boom vang 28 with the vang hook 29, an opening 53 is provided through the body portion of the cushion, as shown in FIG. 3.

It should be noted that other types of fasteners may be utilized to connect or mount the cushion to the boom. For instance, the straps 50 may be separately provided and secured by wrapping entirely about the cushion and united together utilizing conventional fastening elements including hook and loop fasteners, buckles or bayonet type fasteners. Also, in addition to forming the body in a single length, it is possible that the cushion may be formed with two or more separate body portions each being secured to the boom along a portion of the length thereof.

With specific reference to FIGS. 5 through 7, a further embodiment of the present invention is disclosed in detail. In this embodiment, the boom is shown as being generally rectangular in cross section and is designated at 22'. As previously discussed, a rail 33 is mounted along the upper surface of the boom to which slidable clips 32 are secured which connect the foot of the mainsail to the rail. In this embodiment, the cushion 60 is defined by a pair of opposing body sections 61 and 61' each having a first or mast end 62 and an outer end 63. Each section also includes opposite side edges 64 and 65. As shown in FIG. 7, strips of hook and loop material 66 and 67 are provided along the length of the sections 61 and 61' adjacent the sides 64 and 65 and along the inner surfaces thereof.

In order to mount the body sections 61 and 61' to the boom, a pair of strips of mating hook and loop fabric fastening materials 68 are adhesively secured in spaced relationship to the upper surface of the boom and a pair of parallel strips of hook and loop fastening material 69 are mounted in spaced relationship along the lower surface of the boom. The body sections 61 and 61' are mounted so as to completely cover the opposite sides of the boom, as shown in FIG. 4, by securing each of the body sections 61 and 61' to the boom by connecting the strips 64 with the strips 68 at the top of the boom and the strips 67 with the mating strips 69 on the bottom of the boom.

Figure 9:
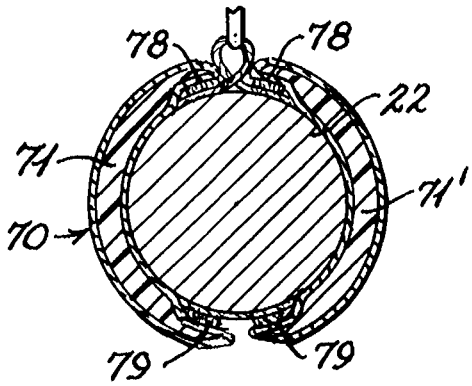
FIG. 9 is a cross-sectional view similar to that of FIG. 5 wherein the cushion body sections shown in FIG. 8 are mounted on opposing sides of a boom having a generally circular cross section.
Figure 12:
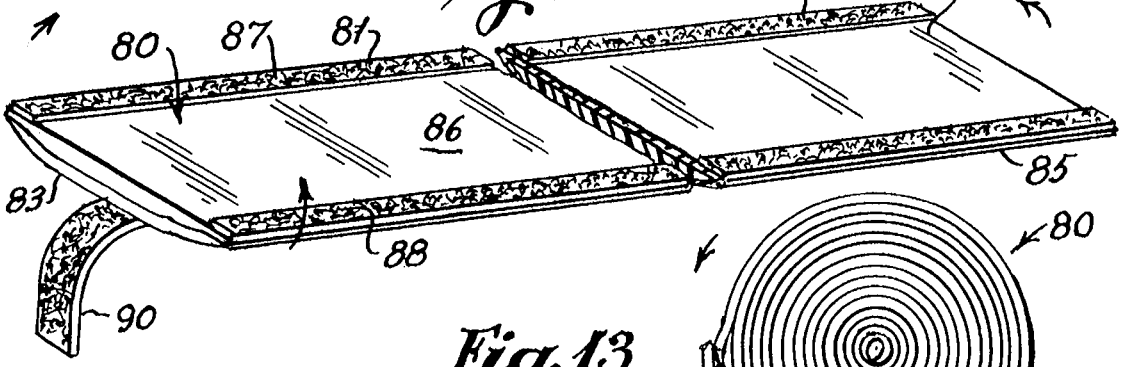
FIG. 12 is a perspective view having portions broken away, of the flexible resilient cushion shown in FIG. 10.

With specific reference to FIGS. 8 and 9, another embodiment of the present invention is disclosed which incorporates features of the previous two embodiments. In this embodiment, the cushion 70 includes a pair of opposing body portions 71 and 71' which have concave facing inner surfaces 72 and upper and lower elongated edges 73 and 74. Each body portion is pre-formed so that the two bodies may be brought into opposing engagement with the boom 22, as shown in FIG. 9. Hook and loop strips 75 and 76 are provided on the inner surface adjacent each of the sides of each body portion and mate with hook and loop fastening strips 78 and 79 applied along the length of the boom. In this embodiment, separate straps such as those shown at 50 may also be utilized to mount the sections 71 and 71' to the boom.

Figure 10:
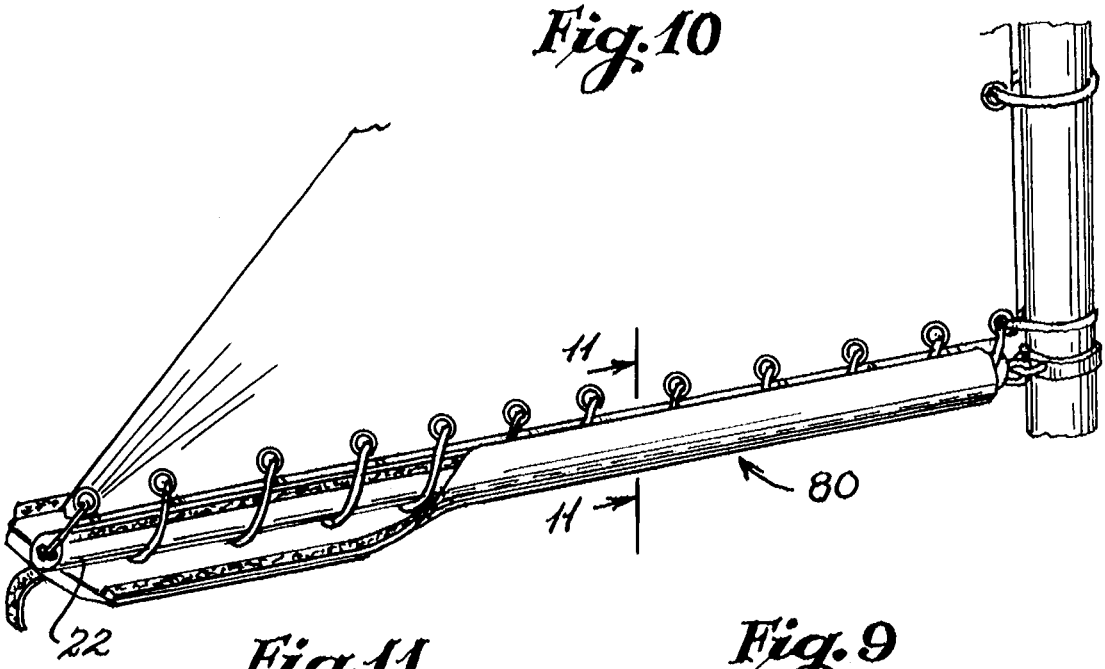
FIG. 10 is a perspective illustrational view of another embodiment of the present invention wherein the cushion is formed of a relatively flexible resilient sheet which is secured along the length of the boom by mating fastening materials.
Figure 11:
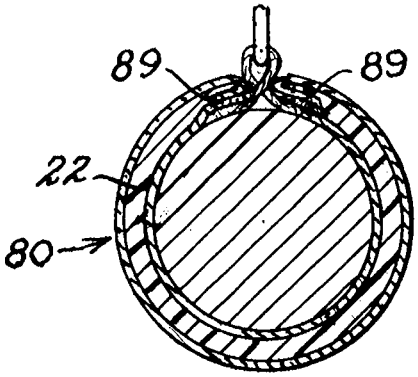
FIG. 11 is a cross-sectional view taken along 11—11 of FIG. 10.

With continued reference to FIGS. 9–13 of the drawing figures, another embodiment of the invention is discussed in greater detail. In this embodiment, the protective cushion 80 is formed as a sheet of soft resilient material having the same characteristics with respect to deformability and impact resistance as discussed above with respect to the previous embodiments. The cushion includes a body portion 81 having opposite end portions 82 and 83 and opposite elongated sides 84 and 85. In order to mount the flexible sheet to the boom 22 of a sailboat, the inner surface 86 thereof is provided with a pair of generally parallel strips of hook and loop type fastening materials 87 and 88 which extend adjacent each of the sides 84 and 85. The width of the body between the sides 84 and 85 is sufficient for the body to be wrapped about the sides and bottom of the boom, as shown in FIG. 10, thereafter being secured by engagement with a pair of generally parallel hook and loop material strips 89 which are adhesively or otherwise secured along the length of the upper portion of the boom. In this embodiment, one of the hook and loop fabric strips 87 or 88 is secured to one of the mating strips 89 on the boom and thereafter the body of the cushion is wrapped about the boom and the other of the hook and loop strips is secured to the other of the hook and loop fabric strips 89 secured to the boom.

Figure 13:
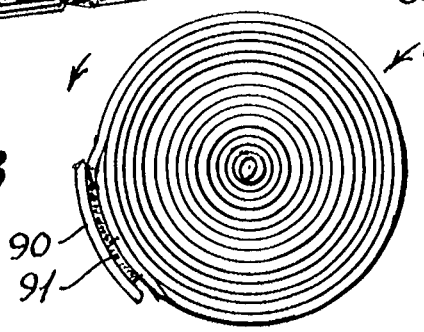
FIG. 13 is an illustrational view of the embodiment of FIG. 12 being rolled into a compact configuration.
Figure 14:
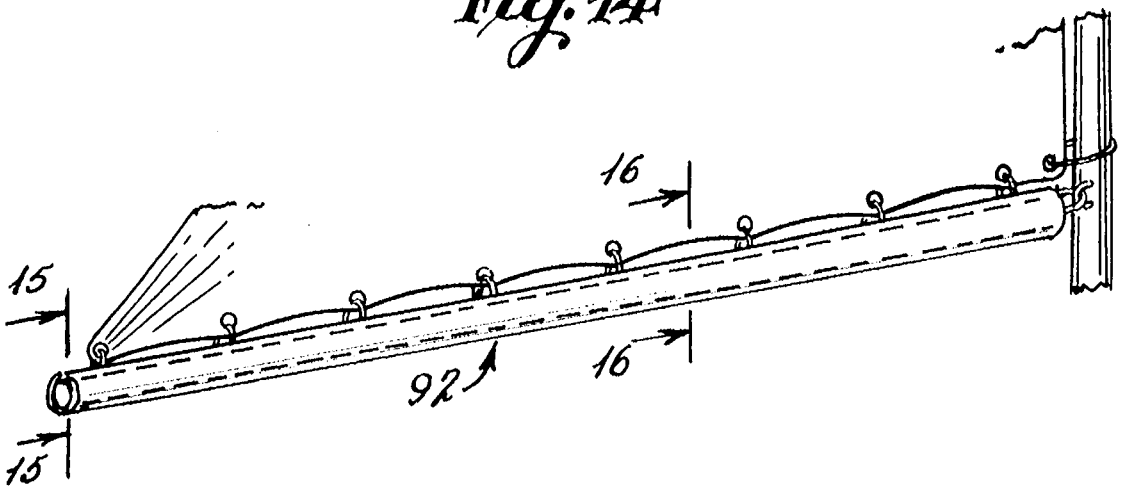
FIG. 14 is a perspective view of a boom covered with another embodiment of protective cushion constructed in accordance with the teachings of the present invention.
Figure 15:
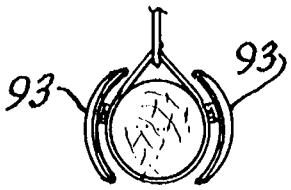
FIG. 15 is an enlarged view taken along line 15—15 of FIG. 14.
Figure 16:
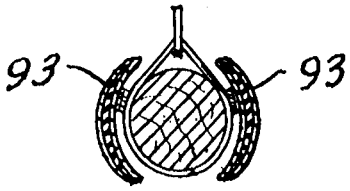
FIG. 16 is an enlarged cross-sectional view taken along line 16—16 of FIG. 14.

The present embodiment may also be formed of a sheet of soft resilient material which tapers inwardly along its length to thereby conform to a tapering boom in much the same manner as discussed with the embodiment shown in FIGS. 1–4. With the present embodiment, the flexible body may be rolled upon itself, as shown in FIG. 13, and thereafter secured with a hook and loop fastening strap 90 to a mating pad 91 provided on the outer surface adjacent the opposite end 82 of the sheet so that, when not in use, the cushion may be conveniently and compactly stored.

Figure 17:
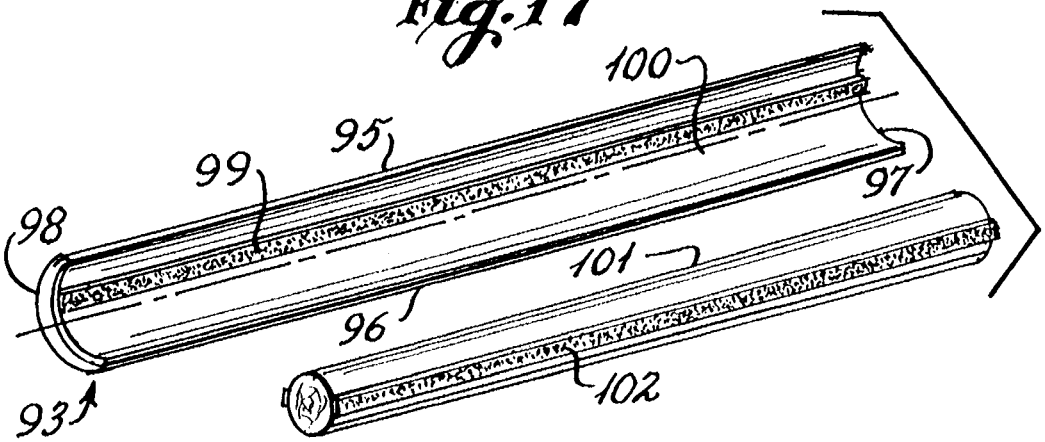
FIG. 17 is a perspective assembly view showing one cushion element of the embodiment of FIG. 14 and a portion of the boom having a fastening material applied thereto in accordance with the teachings of the embodiment of FIG. 14.

A further embodiment of the present invention is disclosed in FIGS. 14–17. In this embodiment, the protective cushion 92 includes a pair of opposing generally flexible padded sections 93. Each of the sections 93 is made of a soft resilient material similar to the materials previously discussed. Each section includes an upper elongated edge 95 and lower elongated edge 96 and opposite ends 97 and 98. A single strip of a hook-and-loop or other type of fastening material 99 is secured along the inner surface 100. The strip is applied so as to be spaced from both the upper and lower edges 95 and 96, as is shown in FIG. 17.

To mount the opposing sections 93 to the boom, a pair of mating hook-and-loop or other fastening materials 101 and 102 are applied along the length of the boom and on generally opposite sides thereof and slightly above the center line of the boom. When the strips 99 associated with each section are engaged with the either one of the strips 101 or 102, the cushioned sections will hang relative to the engaged strips so that the lower edge of the section is suspended below the lower surface of the boom. When it is desired to store the protective cushion 92, the sections 93 are simply pulled from there engaging relationship with the strips 101 and 102 boom and thereafter folded or rolled for storage.

In each of the embodiments of the present invention, it is important that at least the outer surface, and preferably both the inner and outer surface, of each body portion or section of the cushion be coated with a moisture impermeable layer. The moisture resistant layer should be flexible so as to yield together with the material forming the body of the cushion but provide resistance to moisture seeping into the body of the cushion and protect the cushion from destruction from salt water.

The foregoing description of the preferred embodiment of the invention have been presented to illustrate the principles and not to limit the invention to the particular embodiments illustrated. It is intended that the scope of the invention be defined by all of the embodiment encompassed within the following claims and their equivalence.

I claim:

1. A protective device for use with a boom on a sailboat wherein the boom includes an outer end and a mast end, upper, lower and opposite side portions, the device comprising, a cushion means having a body portion formed of a soft resiliently yieldable material, said body portion having inner and outer surfaces, opposite sides and ends, and fastening means for mounting said body portion in substantially encircling relationship about the boom intermediate the outer and mast ends thereof.

2. The protective device of claim 1, in which said body portion includes a substantially continuous tubular sleeve, and said opposite sides of said body portion being spaced in generally opposing relationship with one another.

3. The protective device of claim 2, in which said fastening means includes a plurality of straps having first and second ends, means for securing said first end of said straps to said body portion adjacent one of said opposite sides thereof, and releasably securing means for securing said second ends of each of said straps to said outer surface of said body portion.

4. The protective device of claim 3, in which each of said straps includes and inner and outer surface, a first hook and loop fastening material mounted to said outer surface of each of said straps adjacent said first end thereof and a second hook and loop fastening material mounted to said inner surface of each said straps adjacent said second ends thereof whereby said first and second hook and loop fastening materials are selectively engageable with one another.

5. The protective device of claim 2, including a moisture impermeable coating on said inner and outer surfaces of said body portion.

6. The protective device of claim 5, in which said material is selected from a group of materials consisting of natural and synthetic spongy rubbers, foam and natural and synthetic fibers.

7. The protective device of claim 6, in which material is substantially ¾ of an inch or greater in thickness.

8. The protective device of claim 1, including an opening in said body portion spaced between said opposite sides and ends thereof through which an attaching element on the boom may extend when said body portion is mounted to the boom.

9. The protective device of claim 1, in which said body portion includes first and second sections having opposing inner surfaces for engaging the opposite sides of a boom therebetween, said inner and outer surfaces of said body portions provided with a moisture impermeable layer.

10. The protective device of claim 9, in which each of said inner surfaces of said first and second sections is generally concave in configuration.

11. The protective device of claim 9, in which material is substantially ¾ of an inch or greater in thickness.

12. The protective device of claim 11, in which said material is selected from a group of materials consisting of natural and synthetic spongy rubbers, foam and natural and synthetic fibers.

13. The protective device of claim 1, in which said body portion includes first and second sections having opposing inner surfaces for engaging the opposite sides of a boom therebetween, and fastening means including first securing elements securable along the boom and second securing elements mounted to each of said first and second sections, said first and second securing elements being engageable with one another to secure said first and second sections to the boom.

14. The protective device of claim 13, in which said first securing elements include a pair of generally parallel hook and loop fastening material strips which may be mounted to the boom and said second securing elements including second strips of hook and loop fastening materials.

15. The protective device of claim 13, in which material is substantially ¾ of an inch or greater in thickness.

16. The protective device of claim 15, in which said material is selected from a group of materials consisting of natural and synthetic spongy rubbers, foam and natural and synthetic fibers.

17. The protective device of claim 2, in which said sleeve tapers inwardly from one end portion of said sleeve to the other.

18. The protective device of claim 1, in which said body portion is in the form of a generally pliable sheet, said fastening means including at least one first securing strip selectively positionable along the surface of the boom, and a pair of second securing means extending along said inner face of said body portion adjacent each side thereof.

19. The protective device of claim 18, in which said inner and outer surface of said body portion are provided with a moisture impermeable layer.

20. The protective device of claim 19, in which said material is selected from a group of materials consisting of natural and synthetic spongy rubbers, foam and natural and synthetic fibers.

* * * * *